United States Patent [19]

Ruhaak

[11] 4,080,739

[45] Mar. 28, 1978

[54] BATTER BOARD

[76] Inventor: Donald J. Ruhaak, 116 Arborview Dr., Nebraska City, Nebr. 68410

[21] Appl. No.: 717,417

[22] Filed: Aug. 24, 1976

[51] Int. Cl.[2] ..... E04G 21/18

[52] U.S. Cl. ..... 33/86; 33/1 LE

[58] Field of Search ..... 33/1 LE, 1 H, 86, 85; 182/151; 160/351, 377; 40/125 H, 125 J

[56] References Cited

U.S. PATENT DOCUMENTS

| | | | |
|---|---|---|---|
| 1,609,912 | 12/1926 | Mazeau | 33/1 H |
| 1,651,221 | 11/1927 | O'Maley | 116/63 P |
| 2,562,597 | 7/1951 | Breuninger | 33/86 |
| 2,790,258 | 4/1957 | Freshour | 40/125 H |
| 3,583,466 | 6/1971 | Dreyer | 160/377 |

FOREIGN PATENT DOCUMENTS

| | | | |
|---|---|---|---|
| 478,635 | 2/1953 | Italy | 40/125 H |

*Primary Examiner*—Harry N. Haroian
*Attorney, Agent, or Firm*—Henderson, Strom & Sturm

[57] ABSTRACT

A batter board for use in building construction having, in one embodiment, two vertical support members and two horizontal alignment members which together maintain a constant spacing between the support members. One of the alignment members is affixed to the support members at the upper ends thereof, while the second alignment member is movably affixed to the support members in such a manner that it may be selectively positioned along the vertical axes of the support members. A slide member is movably affixed to the second alignment member whereby the slide member may be selectively positioned substantially anywhere within the plane defined by the ends of the support members. The basic structure just described may be advantageously modified by the addition of other support and alignment members.

6 Claims, 3 Drawing Figures

BATTER BOARD

BACKGROUND OF THE INVENTION

This invention generally relates to construction aids used in the building trades, and specifically to an improved batter board for use in layout of building perimeters.

Almost every construction project begins with the physical linear definition of all building corners and walls. This initial layout is performed with a plurality of devices commonly known as batter boards. More specifically, batter boards are positioned in every corner of the proposed building location with lines, or cords, running from batter board to batter board representing the outside dimensions of the building walls. The lines extending between batter boards are maintained in a level relationship with each other and are positioned to provide a true representation of the building corners.

The most primitive construction of batter board, namely wooden scrap lumber driven in the ground and nailed together, is, suprisingly, widely used today. The reason for continued use of such as inconvenient and cumbersome aid is that previously proposed batter boards have not, for various reasons, found acceptance in the trade.

SUMMARY OF THE INVENTION

One of the objects of this invention is to provide an improved batter board which is both simple in construction and convenient in use.

Another object of this invention is to provide a batter board that is reusable over an indefinate period of time.

A further object of this invention is to provide a batter board that is quickly and easily assembled and disassembled.

Another object of this invention is to provide a batter board that is of unitized construction for promoting versatility.

Another object of this invention is to provide a batter board which is extremely efficient in use, simple in construction, and economical in manufacture.

Still another object of this invention is to provide a batter board that has a selectively adjustable line attachment member which promotes ease of level and square determination.

These and other objects are accomplished in accordance with this invention by providing a batter board having, in one embodiment, two vertical support members and two horizontal members which together maintain a constant spacing between the support members. One of the alignment members is affixed to the support members at the upper ends thereof, while the second alignment member is movably affixed to the support members in such a manner that it may be selectively positioned along the vertical axes of the support members. A slide member is movably affixed to the second alignment member whereby the slide member may be selectively positioned substantially anywhere within the plane defined by the ends of the support members. The basic structure just described may be advantageously modified by the addition of other support and alignment members.

BRIEF DESCRIPTION OF THE DRAWINGS

For a better understanding of the invention as well as other objects and further features thereof, reference is made to the following detailed disclosure of the invention taken in conjunction with the accompanying drawings wherein.

DESCRIPTION OF THE PREFERRED EMBODIMENTS

Figure 1:
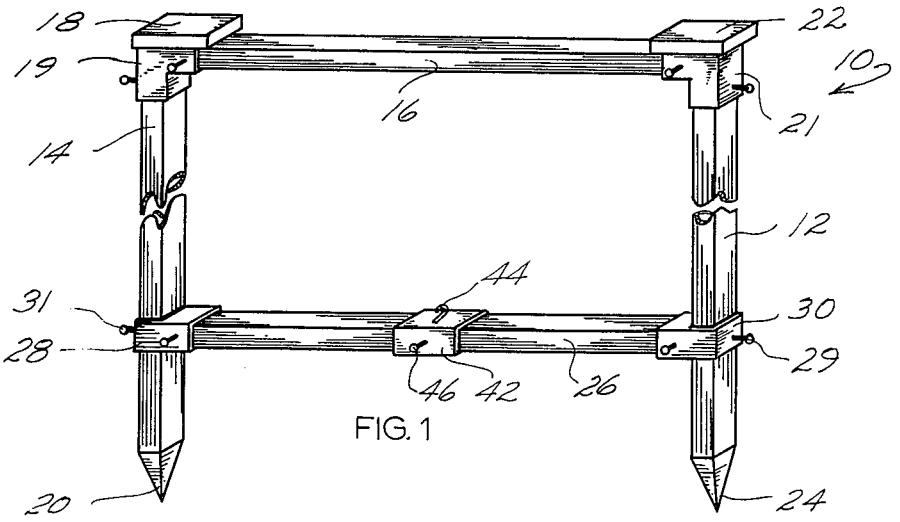
FIG. 1 is a perspective view of one embodiment of the invention, showing the general arrangement of elements of a "single" batter board.

Referring to FIG. 1, there is shown a batter board comprising two support members 12 and 14 and two alignment members 16 and 26. This structure will hereinafter be referred to as a "single." For purposes of explanation, attention is directed to FIG. 3 which shows what is hereinafter referred to as a "double" and consists of the three support members, or legs, 50, 52, and 54, and four alignment members 56, 64, 72, and 74.

Batter board 10 is substantially comprised of five basic elements. Two elongated post-like members 12 and 14 provide the basic support for the batter board structure. These support members can be of any suitable cross-sectional configuration; however, it has been found most advantageous to have them rectangular in that such configuration provides a more stable structure. Also, the support members can be of any suitable length, but it has been found that a length of between 3–6 feet is quite satisfactory.

Alignment member 16 has end caps thereon, 19 and 21, which fit over the ends of support members 12 and 14. Attached to, and on top of, the end caps 19 and 21 are plates 18 and 22 which serve as an impact surface for driving the support members into the ground. Thus, it is readily seen that the top alignment member serves both as a means to maintain the proper separation between support members and as an aid for affixing the batter board in position at the construction sight. Obviously, the lower ends of the support members may be modified in any of a number of ways to facilitate driving into the ground, such as, for example, by providing points 20 and 24.

Alignment member 26 also extends between support members 12 and 14; however, rather than being relatively fixed in one location, alignment member 26 is fitted at its remote ends with couplings 28 and 30 which permit the alignment member to be moved vertically along the axes of support members 12 and 14. The couplings 28 and 30 merely fit around the diameter of the support members and are sufficiently large to permit an easy sliding action. It should be readily apparent that the couplings may be integral with the alignment member, or separate therefrom and affixed thereto with any type of suitable mechanical fastener. Also, it should be apparent that any suitable means may be employed to temporarily fix the couplings to the support members, such as, for example, wing nuts 29 and 31.

A slide member 42 is movably attached to movable alignment member 26 and can be selectively positioned substantially anywhere along the length thereof between support members 12 and 14. Slide member 42 is temporarily locked into position on alignment member 26 by any suitable means, such as, for example, wing nut 46. Also, a small hook 44 may be affixed to slide member 42 for easy attachment of the layout line. By fastening one end of a line to slide member 46 an operator may easily and quickly position that line anywhere within the confines of support members 12 and 14.

Figure 2:
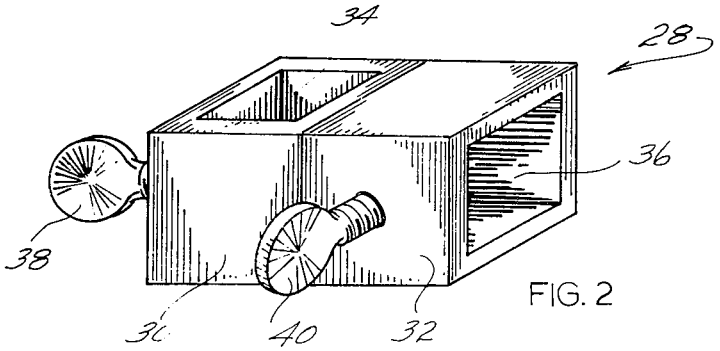
FIG. 2 is a schematic view of a tee element used to secure one end of the adjustable alignment member to the support member.

The tee member 28 of FIG. 1 can be seen in detail in FIG. 2. Member 28 comprises a housing 30–32 having perpendicularly positioned openings 34 and 36 therein. Opening 36 continues through the housing and is of suitable size and shape to accept sliding engagement with support member 14. Opening 36 only partially extends through the housing, and is of suitable size and shape to accept one end of alignment member 26. The temporarily affixment of the members 26 and 14 relative to the tee member 28 is maintained by fastening means such as wing nuts 38 and 40. The tee member 28 is a modified version of coupler 76 of FIG. 3, which simplifies the structural conversion from a "double" to a "single" batter board.

Figure 3:
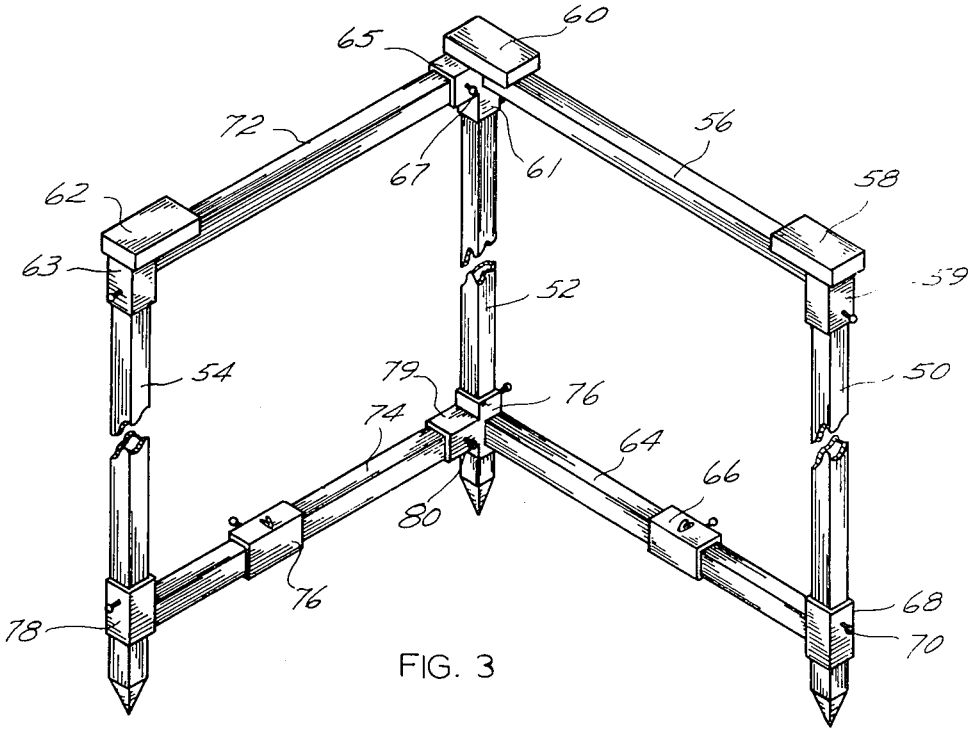
FIG. 3 is a perspective view of another embodiment of the invention, showing the general arrangement of elements of a "double" batter board.

Referring now to FIG. 3, the "double" batter board construction will be described. Structural similarities between this embodiment and that shown in FIG. 1 are readily apparent. Batter board unit 51 includes three support members 50, 52, and 54, two top alignment members 56 and 62, two movable alignment members 64 and 74, and two slide members 66 and 76.

The top alignment members have end caps 59, 61, and 63 which fit over the ends of support members 50, 52, and 54, respectively, and impact surfaces 58, 60, and 62 are affixed thereto. The two top alignment members 56 and 72 are connected, permanently or temporarily, at cap 61 forming a unitary structure which is removable for storage or other purposes. Obviously, any suitable method of connecting the various members may be used. For purposes of description, the top alignment members are shown connected at cap 61 by fixing member 56 to the cap in a permanent fashion, such as welding, and attaching an extension 65 thereto into which alignment member 72 extends for mechanical fastening as by wing nut 67.

Movable alignment members 64 and 74 are interconnected at support 52 by coupling 76, which includes extension 79 into which member 74 extends. Alignment member 74 is affixed to coupling 76 by a wing nut 80.

The structure thus described easily functions to define the corners of a building during the early phases of construction. Lines are attached at one end to the hooks on slide member 66 and 76 which are then separately aligned in the proper horizontal position, then the alignment members 64 and 74, acting as a unit, are moved vertically until the desired vertical line is obtained.

With the structure outlined above, it can be seen that the batter board of the instant invention is easily transportable, assembled and disassembled, and used repeatedly without loss of accuracy or dependability.

It will be understood that various changes in the details, materials and arrangement of parts, which have herein been described and illustrated in order to explain the nature of the invention, will occur to and may be made by those skilled in the art upon a reading of the disclosure within the principles and scope of the invention.

What is claimed is:

1. A batter board unit for use in building construction comprising:

first and second elongate substantially rigid support members each having a first and second end and longitudinal axes which are substantially parallel and in the same plane;

first and second substantially rigid elongate alignment members of approximate equal length having a first and second end, said first alignment member removably affixed at said first end thereof to said first end of said first support member and at said second end thereof to said first end of said second support member, said second alignment member selectively movably affixed at said first end thereof to said first support member and at the second end thereof to said second support member for movement along the longitudinal axes of said support members between said first and second ends thereof;

a first slide member selectively movably affixed to said second alignment member for movement therealong between said first and second support members, whereby said first slide member may be selectively located in substantially any position within the plane defined by the axes of said first and second support members and said first and second ends of said support members;

a third elongate substantially rigid support member having a first and second end and a longitudinal axis which is substantially parallel to the longitudinal axes of said first and second support members, the plane defined by the longitudinal axes of said third and second members being substantially perpendicular to the plane defined by the longitudinal axes of said first and second support members;

third and fourth substantially rigid elongate alignment members of approximate equal length having a first and second end, said third alignment member removably affixed at said first end thereof to said first end of said second support member and at the second end thereof to said first end of said second support member, said fourth alignment member selectively movably affixed at said first end thereof to said second support member and at the second end thereof to said third support member for movement along the longitudinal axes of said second and third support members between said first and second end thereof;

a second slide member selectively movably affixed to said fourth alignment member for movement therealong between said second and third support members whereby said third slide member may be selectively located in substantially any position within the plane defined by the axes of said second and third support members and said first and second ends of said support members;

said second and fourth alignment members are selectively movably affixed to said support members by couplings on the ends of said second and fourth alignment members which at least partially encompass, respectively, said support members, the said second and fourth alignment members both attached to the same coupling on said second support member, whereby said second and fourth alignment members traverse as a unit along the axial direction of said support members.

2. The batter board of claim 1 wherein said first and third alignment members are removably affixed to said support members by caps on the ends thereof which at least partially engage, respectively, said first ends of said support members, said first and third alignment members both attached to the same cap on said second support member.

3. The batter board of claim 2 wherein said support members and alignment members are constructed of square tubing.

4. The batter board of claim 2 wherein said couplings are held in selective location upon said support members and said first slide member is held in selective location upon said second alignment member by adjustable friction means.

5. The batter board of claim 4 including an impact member affixed to each said cap.

6. The batter board of claim 5 wherein said second end of each said support member is pointed.

* * * * *